US006831231B2

(12) United States Patent
Perelman et al.

(10) Patent No.: US 6,831,231 B2
(45) Date of Patent: Dec. 14, 2004

(54) COAXIAL CABLE WITH FLAT OUTER CONDUCTOR

(75) Inventors: Robert D. Perelman, Woodbridge, CT (US); Robert C. Srubas, Granby, CT (US); Kevin Moyher, Clinton, CT (US)

(73) Assignee: Times Microwave Systems, division of Smiths Aerospace, Incorporated, Wallingford, CT (US)

( * ) Notice: Subject to any disclaimer, the term of this patent is extended or adjusted under 35 U.S.C. 154(b) by 0 days.

(21) Appl. No.: 10/192,205

(22) Filed: Jul. 10, 2002

(65) Prior Publication Data

US 2003/0102147 A1 Jun. 5, 2003

Related U.S. Application Data

(63) Continuation-in-part of application No. 10/004,697, filed on Dec. 5, 2001, now Pat. No. 6,610,931.

(51) Int. Cl.[7] ..... H01B 7/18
(52) U.S. Cl. ..... 174/102 R; 333/237
(58) Field of Search ..... 174/28, 36, 102 R, 174/102 SP; 333/237, 244

(56) References Cited

U.S. PATENT DOCUMENTS

| | | | | |
|---|---|---|---|---|
| 3,106,713 A | * | 10/1963 | Murata et al. | 343/770 |
| 3,691,488 A | | 9/1972 | Holtum, Jr. | 333/84 R |
| 4,339,733 A | * | 7/1982 | Smith | 333/237 |
| 4,366,457 A | | 12/1982 | Bode et al. | 333/237 |
| 4,800,351 A | | 1/1989 | Rampalli et al. | 333/237 |
| 5,276,413 A | | 1/1994 | Schulze-Buxloh | 333/237 |
| 5,291,164 A | | 3/1994 | Levisse | 333/237 |
| 5,339,058 A | | 8/1994 | Lique | 333/237 |
| 5,422,614 A | | 6/1995 | Rampalli et al. | 333/237 |
| 5,521,331 A | * | 5/1996 | Hillburn | 174/36 |
| 6,292,072 B1 | | 9/2001 | Bode et al. | 333/237 |

FOREIGN PATENT DOCUMENTS

| | | | |
|---|---|---|---|
| DE | 300 4882 C2 | 10/1989 | H01Q/13/20 |

* cited by examiner

*Primary Examiner*—Chau N. Nguyen
(74) *Attorney, Agent, or Firm*—McCormick, Paulding & Huber LLP

(57) ABSTRACT

A flexible coaxial cable includes an inner conductor, and a dielectric layer generally surrounding the inner conductor. A tape outer conductor generally surrounds the dielectric layer, and does not underlie another electrically conductive layer such as a braided wire layer. The tape outer conductor may include a surface defining a plurality of indentations for minimizing damage to the tape outer conductor resulting from repeated flexing of the cable, and may define a plurality of apertures to enable generation of radiating waves during signal excitation of the cable.

34 Claims, 2 Drawing Sheets

COAXIAL CABLE WITH FLAT OUTER CONDUCTOR

REFERENCE TO PARENT APPLICATION

This is a continuation-in-part of application Ser. No. 10/004,697, filed Dec. 5, 2001 now U.S. Pat. No. 6,610,931, the disclosure of which is herein incorporated by reference.

FIELD OF THE INVENTION

This invention relates generally to coaxial cables, and more particularly to flexible coaxial cables with flat outer conductor layers.

BACKGROUND OF THE INVENTION

Coaxial cables have employed several different types of outer conductors. Four types of outer conductors commonly used are as follows:

1) braided wire employed for the outer conductor providing excellent flexibility, but resulting in bulky cables with high attenuation and poor RF shielding at a relatively high cost;
2) flat tape with braid applied over it providing lower attenuation and better RF shielding, but not having as good flexibility as the braided wire outer conductor, and having a slightly higher cost;
3) corrugated copper or aluminum tubes providing excellent shielding and low loss, but being stiff and expensive; and
4) smooth wall copper or aluminum tubes providing the lowest loss and excellent shielding, but being extremely stiff and expensive.

Smooth aluminum or copper tapes such as those commonly applied underneath a braid can be applied without a braid, but the resulting cable is typically stiff and has a very limited flex life.

It is a general object of the present invention to provide a flexible coaxial cable that avoids the above-mentioned drawbacks.

SUMMARY OF THE INVENTION

In a first aspect of the present invention, a flexible coaxial cable comprises an inner conductor, a dielectric layer generally surrounding the inner conductor, and a generally flat outer conductor extending circumferentially at least partly about the dielectric layer, and not underlying a separable additional electrical conductor. The generally flat outer conductor includes a surface defining a plurality of indentations for minimizing damage to the generally flat outer conductor resulting from repeated flexing of the cable. Moreover, the dielectric layer is partly exposed to enable generation of radiating waves during signal excitation of the cable.

In a second aspect of the present invention, a flexible coaxial cable comprises an inner conductor, a dielectric layer generally surrounding the inner conductor, and a tape outer conductor extending circumferentially at least partly about the dielectric layer, and not underlying a separable additional electrical conductor. The tape outer conductor includes a surface defining a plurality of indentations for minimizing damage to the tape outer conductor resulting from repeated flexing of the cable. Moreover, the dielectric layer is partly exposed to enable generation of radiating waves during signal excitation of the cable.

In a third aspect of the present invention, a flexible coaxial cable comprises an inner conductor, a dielectric layer generally surrounding the inner conductor, and a generally flat outer conductor circumferentially extending at least partly about the dielectric layer, and not underlying a separable additional electrical conductor.

A first advantage of the present invention is that the coaxial cable is inexpensive relative to a coaxial cable having a braided wire layer.

A second advantage of the present invention is that the coaxial cable is smaller in diameter and of lower weight relative to a coaxial cable having a braided wire layer.

A third advantage of the present invention is the relatively small diameter cable without a braided wire layer lends itself to ease of installation.

Other advantages will be made apparent with reference to the description and accompanying drawings.

DETAILED DESCRIPTION OF THE PREFERRED EMBODIMENTS

Figure 1:
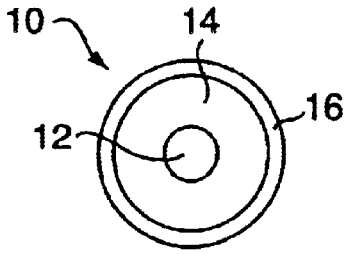
FIG. 1 is a cross-sectional end view of a flexible coaxial cable in accordance with the present invention.

With reference to FIG. 1, a flexible coaxial cable embodying the present invention is generally designated by the reference number 10. The cable 10 includes an inner conductor 12, a dielectric layer 14 generally circumferentially surrounding the inner conductor, and a generally flat outer conductor 16, such as preferably but not limited to, an electrically conductive tape generally circumferentially surrounding and bonded or unbonded to the dielectric layer, and not underlying a separable additional electrical conductor, such as a braided wire layer. However, the outer conductor 16 may be inseparably covered with a coating of another electrically conductive material such as, for example, silver.

The inner conductor 12 may be any electrically conductive material such as, but not limited to, copper and aluminum, and in exceptional cases may be gold and silver. Moreover, the inner conductor 12 may be in either solid, stranded or tube form. The dielectric layer 14 may be any electrically insulating material such as, but not limited to, foam or solid polyethylene. The generally flat outer conductor 16 may be any electrically conductive material such as, but not limited to, aluminum, copper, silver and gold, as well as composites and laminates thereof. For example, the flat outer conductor 16 as an electrically conductive tape may be a composite of layers preferably including aluminum, an electrical insulator and an adhesive layer. More preferably, the composite of layers is the following sequence from outer to inner layer: aluminum, electrical insulator, aluminum and adhesive. The electrical insulator is preferably a polyester film sold under the trademark MYLAR.

By way of example of a generally flat outer conductor, a flat tape outer conductor will be explained and illustrated in several embodiments. However, other types of generally flat outer conductors may be substituted without departing from the scope of the present invention. Tape outer conductors are employed herein without an overlying braided wire layer in order to lower attenuation, cost and size of the cable, as well as to improve RF shielding for non-radiating cables. It has been discovered that coaxial cables with smooth tape outer conductors not covered by additional layers such as a braided wire or insulation jacket significantly reduces the cost and diameter of the cable, and lends itself to ease of installation in a closed and controlled environment where space is limited. However, a tape outer conductor does not have as good flexibility as a braided wire outer conductor. Tape outer conductors typically have little elasticity when bent and consequently tend to crack or otherwise be damaged when repeatedly bent or flexed such that the fatigue life of cables having tape outer conductors is lower relative to cables having braided wire outer conductors. Moreover, cracking of the tape outer conductor is detrimental to the electrical performance (such as shielding and attenuation loss) of the coaxial cable.

It has been discovered that embossing or otherwise defining a plurality of indentations throughout a surface of a tape outer conductor reduces the bending moment of the cable and significantly increases its flex life without adversely affecting the electrical performance of the cable. More specifically, the indentations provide an elasticity to it when flexed so as to prevent the development of cracks in the tape outer conductor which otherwise would cause the conductor to suffer from high attenuation loss and degraded shielding. The resulting cable has the advantages of low loss, excellent RF shielding for non-radiating cables, low cost, small diameter and low weight as compared to braided wire cables, cables having flat tape with braided wire applied over it, corrugated cables, and smooth wall copper or aluminum cables.

Figure 2:
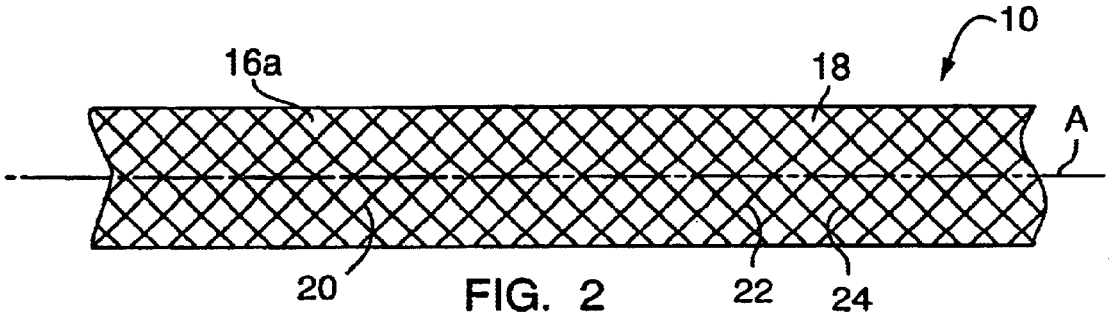
FIG. 2 is a side view of the cable of FIG. 1 showing a first embodiment of an oblique angled crisscross pattern of indentations defined by a tape outer conductor.

Referring now to FIG. 2, the flexible coaxial cable 10 including a tape outer conductor 16*a* in accordance with the present invention is illustrated. The tape outer conductor 16*a* includes a surface 18 defining a plurality of indentations generally in the form of a crisscross pattern 20. Preferably, the surface 18 defining the indentations is facing radially outwardly from a central longitudinal axis A of the cable, but may be facing radially inwardly without departing from the scope of the present invention. The crisscross pattern 20 includes a plurality of lines 22, 24 extending along oblique angles relative to the central longitudinal axis A of the cable.

Figure 3:
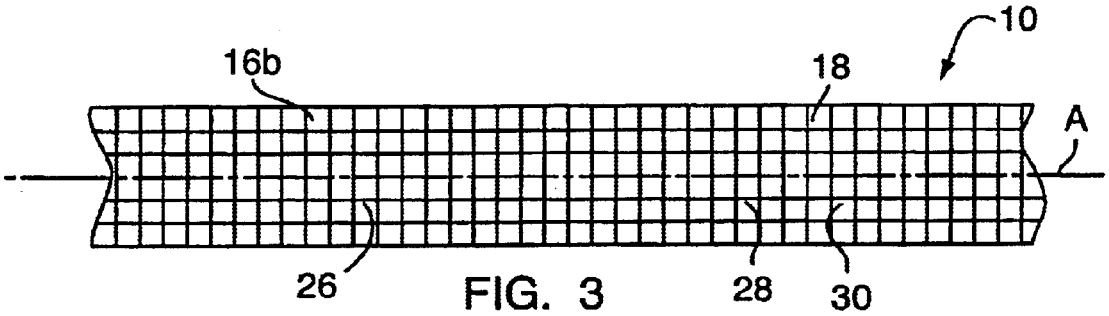
FIG. 3 is a side view of the cable of FIG. 1 showing a second embodiment of a crisscross pattern defined by the tape outer conductor extending in directions parallel and transversely to a longitudinal axis of the cable.

With reference to FIG. 3, the flexible coaxial cable 10 including a tape outer conductor 16*b* in accordance with another embodiment of the present invention is illustrated. The tape outer conductor 16*b* includes a surface 18, preferably facing radially outwardly, defining a plurality of indentations also generally in the form of a crisscross pattern 26. The crisscross pattern 26 includes a plurality of lines 28, 30 extending generally along parallel and transverse directions relative to that of the central longitudinal axis A of the cable.

Figure 4:
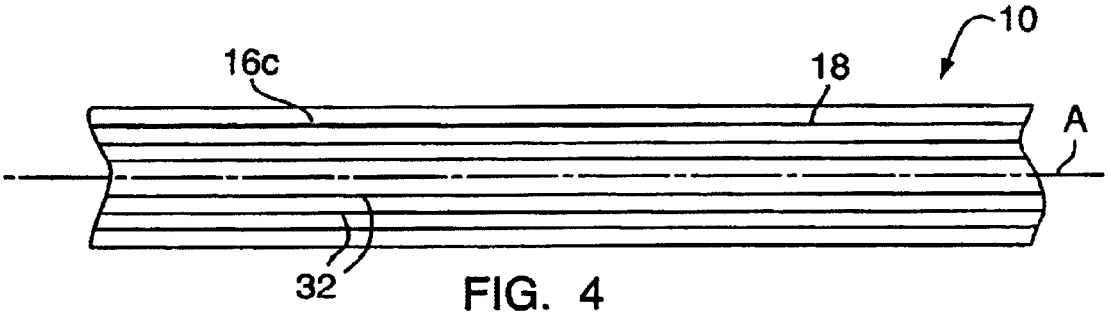
FIG. 4 is a side view of the cable of FIG. 1 showing a third embodiment of a parallel line pattern of indentations defined by the tape outer conductor.

Turning now to FIG. 4, the flexible coaxial cable 10 including a tape outer conductor 16*c* in accordance with a further embodiment of the present invention will be explained. The tape outer conductor 16*c* includes a surface 18, preferably facing radially outwardly, defining a plurality of indentations in the form of a parallel spaced lines 32 extending generally in a direction along the central longitudinal axis A of the cable.

Figure 5:
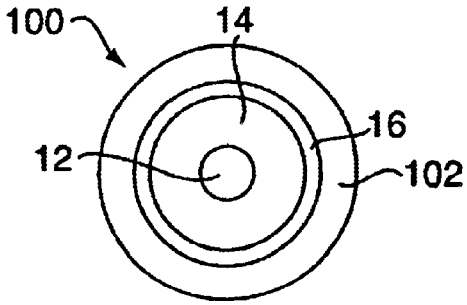
FIG. 5 is a cross-sectional end view of a flexible coaxial cable having an insulator jacket surrounding the tape outer conductor in accordance with the present invention.

FIG. 5 illustrates a flexible coaxial cable 100 in accordance with another embodiment of the present invention. The cable 100 is generally the same as the cable 10 of FIG. 1, except that the cable 100 includes an insulator jacket 102 generally circumferentially surrounding the tape outer conductor 16. The jacket is fabricated from an electrical insulator, such as but not limited to, polyethylene and polyvinyl chloride (PVC).

Figure 6:
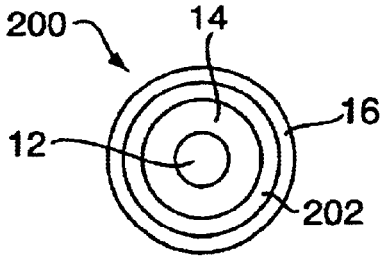
FIG. 6 is a cross-sectional end view of a flexible coaxial cable having an additional layer interposed between the tape outer conductor and the dielectric.

With reference to FIG. 6, a flexible coaxial cable in accordance with a further embodiment of the present invention is generally designated by the reference number 200. The cable 200 is similar to the cable shown and described with respect to FIG. 1, except that at least one additional layer 202 may be interposed between the dielectric layer 14 and the tape outer conductor 18. The additional layer 202 may be another layer of the tape outer conductor 18 or may be electrically non-conductive material such as, but not limited to, polyester, polypropylene or other polymer substrates applied to one or more layers of the tape outer conductor to add stability to the tape outer conductor when the coaxial cable 200 is being flexed. Moreover, the at least one additional layer 202 may be an adhesive layer such as, but not limited to, a low molecular weight polyethylene or polyethylene copolymer such as ethylene acrylic acid (EAA) or ethylene ethyl acrylate (EEA) to adhere the tape outer conductor 18 to the dielectric layer 14. When employing a plurality of layers of electrically conductive tape, the plurality of indentations are preferably defined by the layer of tape farthest from the dielectric layer. However, the plurality of indentations may also be defined on all of the layers of tape without departing from the scope of the present invention.

Figure 7:
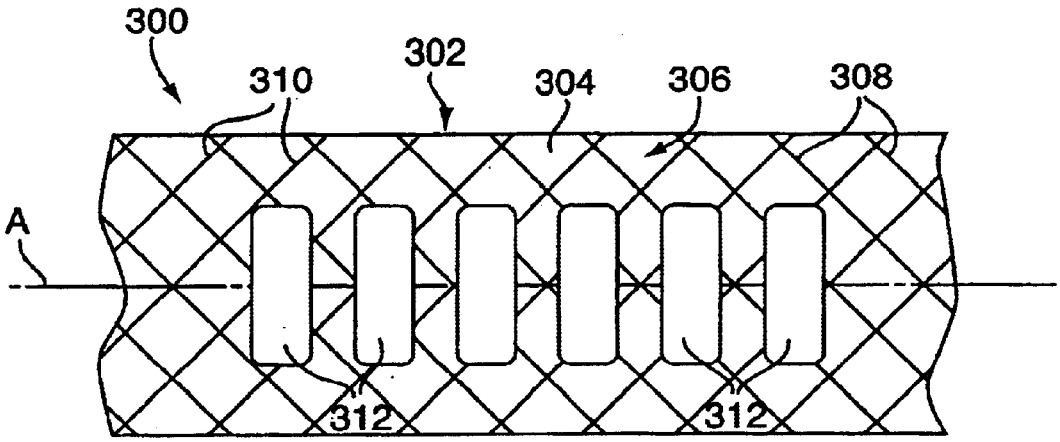
FIG. 7 is a side view of a flexible radiating coaxial cable in accordance with an embodiment of the present invention.

Turning now to FIG. 7, a flexible coaxial cable in accordance with another embodiment of the present invention is generally designated by the reference number 300. The flexible coaxial cable 300 includes a tape outer conductor 302 having a surface 304 defining a plurality of indentations, for example, in the form of a crisscross pattern 306. Preferably, the surface 304 defining the indentations is facing radially outwardly from a central longitudinal axis A of the cable, but may be facing radially inwardly without departing from the scope of the present invention. The crisscross pattern 306 includes a plurality of lines 308, 310 extending along oblique angles relative to the central longitudinal axis A of the cable. The tape outer conductor further defines a plurality of apertures 312, 312 spaced along the longitudinal length of the cable 300. The apertures 312, 312 serve to create a leaky/radiating coaxial cable as more fully described in U.S. Pat. No. 6,292,072, the disclosure of which is herein incorporated by reference and which is briefly described hereinbelow.

Radio frequency (RF) and microwave frequency electromagnetic waves are transmitted through a coaxial cable in the form of a transverse electromagnetic (TEM) wave. Groups of openings in the outer conductor are used to transfer energy to the outside of the cable. This energy forms mainly a surface wave (Goubau wave) for low operational frequencies (i.e., RF frequencies) and a combination of surface wave and radiated wave for high operational frequencies (i.e., microwave frequencies). The combination of surface wave and radiated wave at high operational frequencies substantially lowers the coupling loss, and does not limit the operational frequency bandwidth of the radiated coaxial cable. The groups of apertures 312, 312 defined in the outer conductor 302 act as feed points to facilitate energy transfer from an internal (TEM) wave to the outside of the coaxial cable 300 as a leaky (Goubau) wave at lower operational frequencies and as a combination of surface wave and radiated wave at higher operational frequencies.

Figure 8:
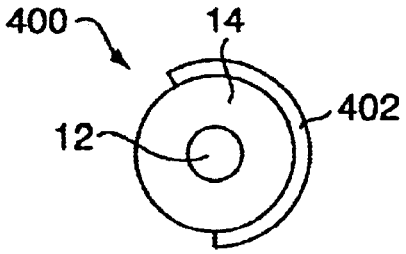
FIG. 8 is a cross-sectional end view of a flexible radiating coaxial cable in accordance with another embodiment of the present invention.

With reference to FIG. 8, a preferred embodiment of a radiating coaxial cable in accordance with another embodiment of the present invention is indicated generally by the reference number 400. Like elements with previous embodiments are designated by like reference numbers. The radiating cable 400 is similar to the cable 10 shown in FIGS. 1–4 except that a generally flat outer conductor 402 extends only partially about the circumference of the cable, and preferably extends about 60% of the circumference in order to expose the dielectric layer 14 to enable generation of radiating waves during signal excitation of the cable.

Although the invention has been shown and described above, it should be understood that numerous modifications can be made without departing from the spirit and scope of the present invention. For example, the flexible coaxial cable having the flat outer conductor defining a plurality of indentations may be covered with a braided layer to improve flexibility and performance over conventional braided coaxial cables. Accordingly, the present invention has been shown and described in several embodiments by way of illustration rather than limitation.

What is claimed is:

1. A flexible coaxial cable comprising:

an inner conductor;

a dielectric layer generally surrounding the inner conductor; and a generally flat outer conductor extending circumferentially at least partly about the dielectric layer, and not underlying a separable additional electrical conductor, the generally flat outer conductor including a surface defining a plurality of indentations for minimizing damage to the generally flat outer conductor resulting from repeated flexing of the cable, and the dielectric layer being partly exposed to enable generation of radiating waves during signal excitation of the cable.

2. A flexible coaxial cable as defined in claim 1, wherein the generally flat outer conductor defines a plurality of apertures to enable the generation of radiating waves during excitation of the cable.

3. A flexible coaxial cable as defined in claim 1, wherein the generally flat outer conductor extends circumferentially partly about the dielectric layer to enable the generation of radiating waves during signal excitation of the cable.

4. A flexible coaxial cable as defined In claim 1, wherein the generally flat outer conductor extends about 60% circumferentially about the dielectric layer to enable the generation of radiating waves during signal excitation of the cable.

5. A flexible coaxial cable as defined in claim 1, wherein the generally flat outer conductor is a tape outer conductor.

6. A flexible coaxial cable as defined in claim 5, wherein the tape outer conductor is aluminum.

7. A flexible coaxial cable as defined in claim 5, wherein the tape outer conductor is copper.

8. A flexible coaxial cable as defined in claim 5, wherein the tape outer conductor is silver.

9. A flexible coaxial cable as defined in claim 5, wherein the tape outer conductor is gold.

10. A flexible coaxial cable as defined in claim 5, wherein the tape outer conductor is covered with a coating of another electrically conductive material.

11. A flexible coaxial cable as defined in claim 10, wherein the coating is silver.

12. A flexible coaxial cable as defined in claim 5, wherein the tape outer conductor is a composite of layers in the following sequence from outer to inner layer: aluminum, electrical insulator, aluminum and adhesive.

13. A flexible coaxial cable as defined in claim 12, wherein the electrical insulator is a polyester film sold under the trademark MYLAR.

14. A flexible coaxial cable as defined in claim 1, wherein the plurality of indentations are generally in the form of a crisscross pattern.

15. A flexible coaxial cable as defined in claim 14, wherein the crisscross pattern is generally a plurality of lines extending along oblique angles relative to a longitudinal axis of the cable.

16. A flexible coaxial cable as defined in claim 14, wherein the crisscross pattern is generally a plurality of lines extending generally perpendicularly and transversely to a longitudinal axis of the cable.

17. A flexible coaxial cable as defined in claim 1, wherein the plurality of indentations generally form parallel spaced lines extending generally along a longitudinal axis of the cable.

18. A flexible coaxial cable as defined in claim 1, wherein the surface defining the plurality of indentations faces radially outwardly.

19. A flexible coaxial cable as defined in claim 1, further including an insulating jacket generally surrounding the generally flat outer conductor.

20. A flexible coaxial cable comprising:

an inner conductor;

a dielectric layer generally surrounding the inner conductor; and a tape outer conductor extending circumferentially at least partly about the dielectric layer, and not underlying a separable additional electrical conductor, the tape outer conductor including a surface defining a plurality of indentations for minimizing damage to the tape outer conductor resulting from repeated flexing of the cable, and the dielectric layer being partly exposed to enable generation of radiating waves during signal excitation of the cable.

21. A flexible coaxial cable as defined in claim 20, wherein the tape outer conductor defines a plurality of apertures to enable the generation of radiating waves during excitation of the cable.

22. A flexible coaxial cable as defined in claim 20, wherein the tape outer conductor extends circumferentially partly about the dielectric layer to enable the generation of radiating waves during signal excitation of the cable.

23. A flexible coaxial cable as defined in claim 20, wherein the tape outer conductor extends about 60% circumferentially about the dielectric layer to enable the generation of radiating waves during signal excitation of the cable.

24. A flexible coaxial cable comprising:

an inner conductor;

a dielectric layer generally surrounding the inner conductor; and a generally flat outer conductor defining a plurality of apertures and extending about 60% circumferentially about the dielectric layer so as to define an opening extending substantially along a length of the conductor to enable generation of radiating waves during signal excitation of the cable, and the generally flat outer conductor not underlying a separable additional electrical conductor.

25. A flexible coaxial cable as defined in claim 24, wherein the generally flat outer conductor is a tape outer conductor.

26. A flexible coaxial cable as defined in claim 25, wherein the tape outer conductor is aluminum.

27. A flexible coaxial cable as defined in claim 25, wherein the tape outer conductor is copper.

28. A flexible coaxial cable as defined in claim 25, wherein the tape outer conductor is silver.

29. A flexible coaxial cable as defined in claim 25, wherein the tape outer conductor is gold.

30. A flexible coaxial cable as defined in claim 25, wherein the tape outer conductor is covered with a coating of another electrically conductive material.

31. A flexible coaxial cable as defined in claim 30, wherein the coating is silver.

32. A flexible coaxial cable as defined in claim 25, wherein the tape outer conductor is a composite of layers in the following sequence from outer to inner layer: aluminum, electrical insulator, aluminum and adhesive.

33. A flexible coaxial cable as defined in claim 32, wherein the electrical insulator is a polyester film sold under the trademark MYLAR.

34. A flexible coaxial cable as defined in claim 24, further including an insulating jacket generally surrounding the generally flat outer conductor.

* * * * *